US012674378B2

(12) United States Patent
Vicente Santos et al.

(10) Patent No.: US 12,674,378 B2
(45) Date of Patent: Jul. 7, 2026

(54) ELECTRIC DRIVE VALVE CONTROL AND SAFETY SYSTEM FOR GAS INJECTION IN OIL PRODUCTION COLUMN

(71) Applicant: OURO NEGRO TECNOLOGIAS EM EQUIPAMENTOS INDUSTRIAIS S/A, Rio de Janeiro (BR)

(72) Inventors: Auderi Vicente Santos, Barra Da Tijuca (BR); Leonardo Goncalves Candido Gomes, Maracana (BR)

(73) Assignee: OURO NEGRO TECNOLOGIAS EM EQUIPAMENTOS INDUSTRIAIS S/A, Rio de Janeiro (BR)

( * ) Notice: Subject to any disclaimer, the term of this patent is extended or adjusted under 35 U.S.C. 154(b) by 46 days.

(21) Appl. No.: 17/769,281

(22) PCT Filed: Oct. 16, 2020

(86) PCT No.: PCT/BR2020/050421

§ 371 (c)(1),
(2) Date: Apr. 14, 2022

(87) PCT Pub. No.: WO2021/072525

PCT Pub. Date: Apr. 22, 2021

(65) Prior Publication Data

US 2024/0141762 A1 May 2, 2024

(30) Foreign Application Priority Data

Oct. 17, 2019 (BR) ..... 102019021843-6

(51) Int. Cl.
*E21B 43/12* (2006.01)
*E21B 47/07* (2012.01)

(52) U.S. Cl.
CPC ..... *E21B 43/123* (2013.01); *E21B 47/07* (2020.05)

(58) Field of Classification Search
CPC ..... E21B 43/123; E21B 47/07
See application file for complete search history.

(56) References Cited

U.S. PATENT DOCUMENTS 3,601,191 A * 8/1971 McMurry ..... E21B 43/123 417/115
4,251,191 A * 2/1981 Gass ..... E21B 34/066 417/54
4,267,885 A * 5/1981 Sanderford ..... E21B 47/07 417/54
4,295,795 A * 10/1981 Gass ..... E21B 43/123 137/155
5,172,717 A * 12/1992 Boyle ..... E21B 34/16 137/155

(Continued)

*Primary Examiner* — Steven A Macdonald
(74) *Attorney, Agent, or Firm* — Dale Paul DiMaggio; Malin Haley DiMaggio & Bowen, P.A.

(57) ABSTRACT

An electric drive valve control and safety system for application in gas injection gas lift valve in oil production column, which guarantees the gas lift (GL) operation and provides fail-safe-close, with greater reliability in the safety conditions of the joint sets of safety barriers (JSB), further enabling the integration of sensors for monitoring the conditions of the gas lift valve (GLV), the gas lift (GL) operation and the safety of the joint set of safety barriers (JSB).

6 Claims, 2 Drawing Sheets

(56) References Cited

U.S. PATENT DOCUMENTS 5,176,164 A * 1/1993 Boyle ..... E21B 43/1235 137/155
5,329,999 A * 7/1994 White ..... E21B 33/1294 166/129
5,458,200 A * 10/1995 Lagerlef ..... E21B 43/123 166/372
5,535,767 A * 7/1996 Schnatzmeyer ..... E21B 34/102 137/155
5,597,042 A * 1/1997 Tubel ..... E21B 43/12 166/250.15
5,662,165 A * 9/1997 Tubel ..... E21B 47/107 166/250.15
5,730,219 A * 3/1998 Tubel ..... E21B 47/017 166/250.1
5,896,924 A * 4/1999 Carmody ..... E21B 34/066 166/69
5,959,547 A * 9/1999 Tubel ..... E21B 47/107 340/853.2
6,006,832 A * 12/1999 Tubel ..... G01V 7/08 166/250.15
6,148,843 A * 11/2000 Pringle ..... E21B 43/123 137/155
6,715,550 B2 * 4/2004 Vinegar ..... E21B 41/02 166/250.15
6,851,481 B2 * 2/2005 Vinegar ..... E21B 34/08 166/73
7,147,059 B2 * 12/2006 Hirsch ..... E21B 34/16 166/372
10,416,080 B1 * 9/2019 Pereira Masiero .... G01N 21/65
10,655,439 B2 * 5/2020 Murdoch ..... E21B 34/066
10,858,921 B1 * 12/2020 Juenke ..... E21B 43/123
10,995,584 B2 * 5/2021 Noel ..... E21B 34/063
10,995,586 B2 * 5/2021 Gonzales Panta .... E21B 34/066
11,035,201 B2 * 6/2021 Frazier ..... E21B 34/08
11,066,921 B1 * 7/2021 Brown ..... E21B 47/14
11,319,773 B2 * 5/2022 Candido Gomes ..... E21B 34/14
11,840,916 B2 * 12/2023 Ferreira Moreira .... E21B 47/12
2001/0017157 A1 * 8/2001 Pringle ..... E21B 43/123 137/155
2002/0029883 A1 * 3/2002 Vinegar ..... E21B 34/066 166/250.03
2002/0043369 A1 * 4/2002 Vinegar ..... H04B 13/02 166/250.07
2002/0121366 A1 * 9/2002 Bass ..... E21B 34/066 166/65.1
2003/0047308 A1 * 3/2003 Hirsch ..... E21B 47/06 166/250.15
2004/0108118 A1 * 6/2004 Williams ..... E21B 43/123 166/386
2009/0250227 A1 * 10/2009 Brown ..... E21B 33/10 166/386
2010/0122819 A1 * 5/2010 Wildman ..... E21B 23/0415 166/117.6
2011/0180267 A1 * 7/2011 Wildman ..... E21B 43/123 137/155
2013/0043031 A1 * 2/2013 Tunget ..... E21B 43/28 166/313
2014/0041863 A1 * 2/2014 Dowling ..... E21B 34/06 166/250.01
2014/0076579 A1 * 3/2014 Salihbegovic ..... E21B 34/10 166/374
2015/0053416 A1 * 2/2015 Molstre ..... E21B 43/122 166/373
2015/0354315 A1 * 12/2015 Windegaard ..... E21B 33/1293 166/183
2016/0053593 A1 * 2/2016 Romer ..... F04F 1/08 700/282
2017/0044876 A1 * 2/2017 Romer ..... E21B 47/07
2017/0198549 A1 * 7/2017 Freeman ..... E21B 43/123
2018/0149002 A1 * 5/2018 Murdoch ..... E21B 47/06
2019/0292879 A1 * 9/2019 Gonzales Panta ..... E21B 43/12
2019/0316440 A1 * 10/2019 Honeker ..... E21B 47/07
2021/0324708 A1 * 10/2021 Candido Gomes ..... E21B 43/12
2022/0112787 A1 * 4/2022 Candido Gomes ..... E21B 47/07
2023/0332483 A1 * 10/2023 Gherren Noel ..... F16K 31/04
2024/0052731 A1 * 2/2024 Shaw ..... E21B 47/008
2024/0240544 A1 * 7/2024 Perrucci ..... E21B 43/123
2025/0122782 A1 * 4/2025 Gherren Noel ..... E21B 34/066

* cited by examiner

ELECTRIC DRIVE VALVE CONTROL AND SAFETY SYSTEM FOR GAS INJECTION IN OIL PRODUCTION COLUMN

CROSS-REFERENCE TO RELATED APPLICATIONS

International Application Number: PCT/BR2020/050421
International Filing Date: 16 Oct. 2020 (16.10.2020)

FIELD OF THE INVENTION

The present invention refers to an electric drive valve control and safety system for gas injection into an oil production column which simultaneously guarantees a gas lift (GL) operation while providings a fail-safe-close, with greater reliability of the safety conditions of the joint sets of safety barriers (JBS) of the well, further enabling the integration of various sensors for monitoring the status of the valve, operation conditions and well.

FUNDAMENTALS OF THE INVENTION

The constant technological evolution in the oil and gas sector has made it possible to exploit reservoirs previously considered unviable for production, and the focus on achieving higher levels of production and recovery has encouraged the development of solutions to maximize the total volume of oil produced in a reservoir, wherein techniques such as artificial elevation have been employed and improved over time.

Artificial lifting methods are used in reservoirs classified as non-surgent, which are characterized by not having enough natural energy to drain the fluid produced to the surface in a viable way.

In order to meet this need, artificial methods of energy intake are applied, in the form of sufficient temperature and/or pressure to the medium, so that it can produce in a viable way.

Even the reservoirs classified as surgent, during the course of their exploration, will present decay of their natural pressure and temperature levels, which will directly affect the production potential, and may reach unviable values, and then become classified as non-surgent, making it necessary to use artificial lifting methods for production continuity.

Currently the industry has several methods of artificial lifting, with different actuation mechanisms, the selection of the most appropriate method being based on the analysis of the characteristics of the reservoir, oil, the infrastructure available in the production unit, costs and other factors.

The gas injection into the production column through the annular space is a method of great versatility and widely used in the oil and gas industry for maintenance or increase of production levels.

This method is known as gas lift operation, where the gas is pressurized in the annular space and, through a one-way valve, is injected into the production column.

The injected gas dissolves in the fluid contained inside the production column, which is mostly crude oil, reducing its specific weight and, consequently, the hydrostatic column above, making it flow more easily to the surface, in view of the reduction of the pressure differential required for such.

The gas injection system infrastructure basically and essentially consists of a gas treatment, pressurization and control unit, positioned in the production unit; a transport line connecting said treatment unit to the head of the well, establishing communication with the annular space, and positioned in the production column, one-way valves of gas injection that communicate the annular space with the production column. Said one-way valves of gas injection being known as gas lift valves (GLV).

BACKGROUND OF THE ART

Currently the gas lift valves (GLV) are of the insertable type, and positioned on a mandrel that make up the production column. Said mandrel, known as the gas lift mandrel (GLM), is characterized by containing a side bag and passages that communicate the annular space with the production column through the gas lift valve (GLV), housed in the side bag.

The gas lift valves (GLV) are one-way, designed to operate always open in the direction of the annular space to the production column, and do not allow the passage in the opposite direction, that is, from the production column to the annular space, a behavior that is obtained through the use of a check type system (see FIG. 2).

The opening and closing of the gas lift valve (GLV) occurs by differential pressure between the annular space and the production column, in a fully mechanical manner, controlled indirectly, by verification and application of pressure in the annular space, without any sensing integrated into the valve.

The gas lift valves (GLV) are mechanically calibrated for opening when a certain pressure value is reached, and under this condition, allow the passage of gas in the desired direction (from annular space to production column), and the gas can be injected continuously or in puffs.

Information from the sector, as well as published articles on the subject, report that the closing mechanisms used in gas lift valves (GLV) do not provide the necessary reliability required by the sector, presenting successive operational failures, the main failures being related to the closure of the check type system and to the valve fitting seals on the mandrel.

For reasons related to the operational safety of the process, it is required that all the wells contain two joint sets of independent safety barriers (JSB), with the gas lift valves (GLV) installed in the production column, below the subsurface safety valve and above the packer, as illustrated in FIG. 2, thus composing the first joint set of the safety barriers (JSB) of the well.

According to safety requirements, the wells must have two joint sets of safety barriers (JSB), so that in case of failure, and consequent communication between the production column and the annular space, the second joint set of safety barriers (JSB) contain the accident, there being no greater damage.

On average, three gas lift valves (GLV) are installed in conventional wells, and, depending on the specific characteristics of the well, a larger or smaller amount of valves may be required.

The gas lift valves (GLV) used in conventional gas injection systems are calibrated for different opening pressures, the latter, which presents lower pressure differential for opening, being responsible for the constant gas injection into the production column, while the others are responsible for the start-up system of the well.

The gas lift valve (GLV) has a one-way check-type device, which consists of an indirect opening and closing mechanism, sensitive to the pressure differential acting under the sealant component, which, when sufficient, compresses the resistance spring, displacing the sealant component, allowing the passage of fluid in the direction of the pressure differential. Further, with the passage of the fluid, the pressure differential decreases, causing the spring to relax, returning the sealing component to the sealing position, closing; an operation that occurs intermittently throughout the regime of gas injection into the production column.

The automatic spring-closing mechanisms, as described above, present operational problems that prevent the correct closure of the valve, and that, in extreme situations, in the well, can cause uncontrolled flow of fluid in the direction of the production column to the annular space, an occurrence listed in the specific literature as one of the main results of failures involving gas lift valves (GLV).

The main causes that lead to this type of failure are waste deposits in the passage region and/or sealant surface; wear of the components, due to operating regime; corrosion of components such as the main valve rod and/or retaining valve, avoiding uniform contact with the hole; error in the calibration of the valve's internal pressure; incorrect fitting in the side pouch; and damage to the valve's external seals.

Another important operational factor to be highlighted is the set of the gas lift valve (GLV) and the accommodation mandrel thereof, which are part of the first joint set of safety barriers (JSB) of the well, and which, as a rule, is considered as a set of fundamental elements to ensure operational safety, and should therefore have a high level of reliability.

What is currently observed is that the gas lift valve (GLV) is not designed and tested following the minimum requirements capable of ensuring operational reliability and integrity of the well, the failure of which compromises the integrity of the first joint set of safety barriers (JSB) and, in turn, the safety levels of the well, and may result in from severe fines for those responsible to disasters and/or accidents.

Although companies invest in the development of means that enhance the reliability and safety of well equipment, among which it is possible to cite the annular safety system described in U.S. Pat. No. 5,329,999, there is still little focus on gas lift valves (GLV) and gas lift mandrels (GLM).

Thus, it is desirable to propose a solution whereby the gas lift valve (GLV) and the gas lift mandrel (GLM) have two main functions; namely, gas injection, ensuring the gas lift (GL) operation, and its fail-safe-close, ensuring the reliability of the joint set of safety barriers (JSB) of the well.

It is also desirable to allow the integration of sensors for monitoring the status of the gas lift valve (GLV), the operating conditions of the gas lift (GL) and the integrity of the joint set of safety barriers (JSB) of the well.

SUMMARY OF THE INVENTION

The main purpose of the present invention is to raise the reliability of the gas injection system, enabling data acquisition and ensuring the integrity of the first joint set of safety barriers (JSB) of the well, from the introduction of sensors and a sealing barrier, between the annular space and the production column, operated electrically with fail-safe-close and integrated to gas lift valve (GLV).

This barrier in conjunction with sensor is provided by the system of the present invention, from the introduction of a control and safety module that, with embedded sensors, activated by command or in an emergency, will ensure fail-safe-close, and the generation of data referring to environmental and operational conditions, preserving the integrity of the first joint set of safety barriers (JSB) of the well.

This control and safety module can be integrated into conventional systems of gas injection and mandrel, or be present in new concepts and designs of gas injection systems.

The main advantages of this solution over the prior art is the fact that it is not a passive system, being actuated from the surface by means of electric cable, with the continuous monitoring of environmental and operational parameters.

The proposed system operates in commanded or emergency situations, without observing problems associated with components wear.

Unlike current passive gas injection systems, which are operated exclusively as a result of increased pressure in the annular space, without any communication mechanism with the surface, the present solution proposes the integration of the fail-safe-close mechanism and sensors to the system, to ensure seal tightness and monitoring of all the parameters involved in the operation.

This solution offers a tremendous advantage, as it guarantees the operator the fail-safe-close of the system and enables real-time monitoring of pressure conditions, temperature, vibration, flow, flow direction, in addition to other parameters, improving decision-making on operations.

Another advantage associated to safety occurs in the initial phase of the gas injection operation, when all the completion fluid present in the annular space of the well must flow through the start-up valves and finally the injection valves to then initiate the gas injection; this operation currently results in risks to the integrity of the valve, in particular the sealant element of the check valve.

The proposed solution ensures the seal tightness of the system, keeping the first joint set of safety barriers (JSB) of the well intact in case of the check valve failure.

In relation to this aspect, in view of the sealing mechanism being less exposed to the flow, it prevents wear and the deposition of residues in the passages and sealing surfaces, which are great advantages over conventional solutions, since this is one of the main causes for gas lift valves failures.

The opening and closing command of the proposed gas injection system is carried out by means of an electrically actuated device driven from the surface by means of electric cable, so that with the mechanism in the fully open position, it will be locked and can only be released by the command, or interruption in the supply of electricity, returning to the closing condition, which configures an operational advantage over the current valves that act intermittently, depending on the pressure in the annular space of the well, being therefore less subject to failures by deformations, wear and damage of the sealing elements and their seats.

DESCRIPTION OF THE DRAWINGS

For a better understanding of the control and safety system proposed herein, reference is made to the accompanying drawings, so that it can be reproduced by an appropriate technique, characterizing its functionality, but these drawings are merely illustrative, and may vary, provided that they do not stray from their functional principle, and where.

Figure 1:
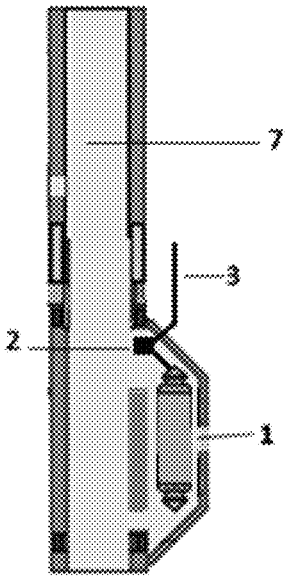
FIG. 1 illustrates the instant invention with a gas lift valve (GLV) from the state of the art positioned in a mandrel with a side pocket constituting part of the production column, where the control and safety module is installed.
Figure 2:
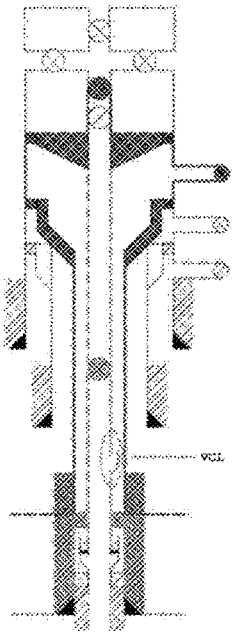
Figure 2 Prior art
FIG. 2 illustrates the instant invention with a gas lift valve (GLV) positioned in a mandrel with a side pocket constituting part of the production column, in non-operating condition.
Figure 3:
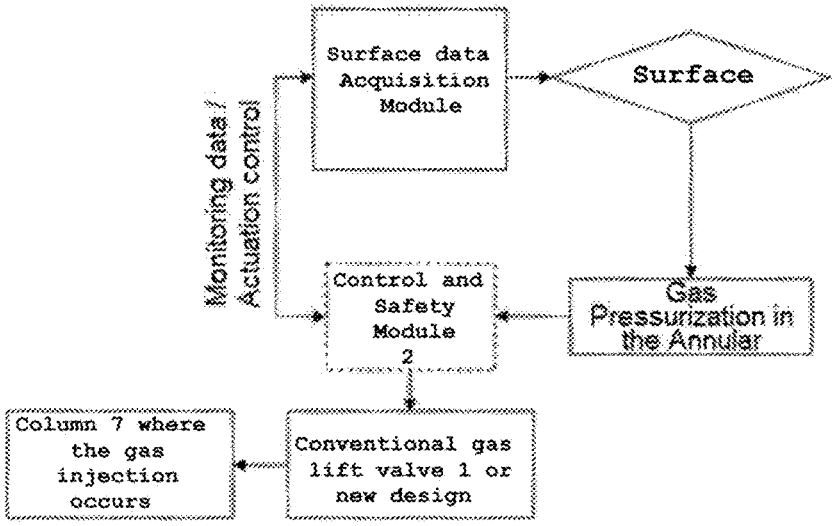
FIG. 3 illustrates a block diagram of the gas lift operation of the control and safety system of the present invention.
Figure 4:
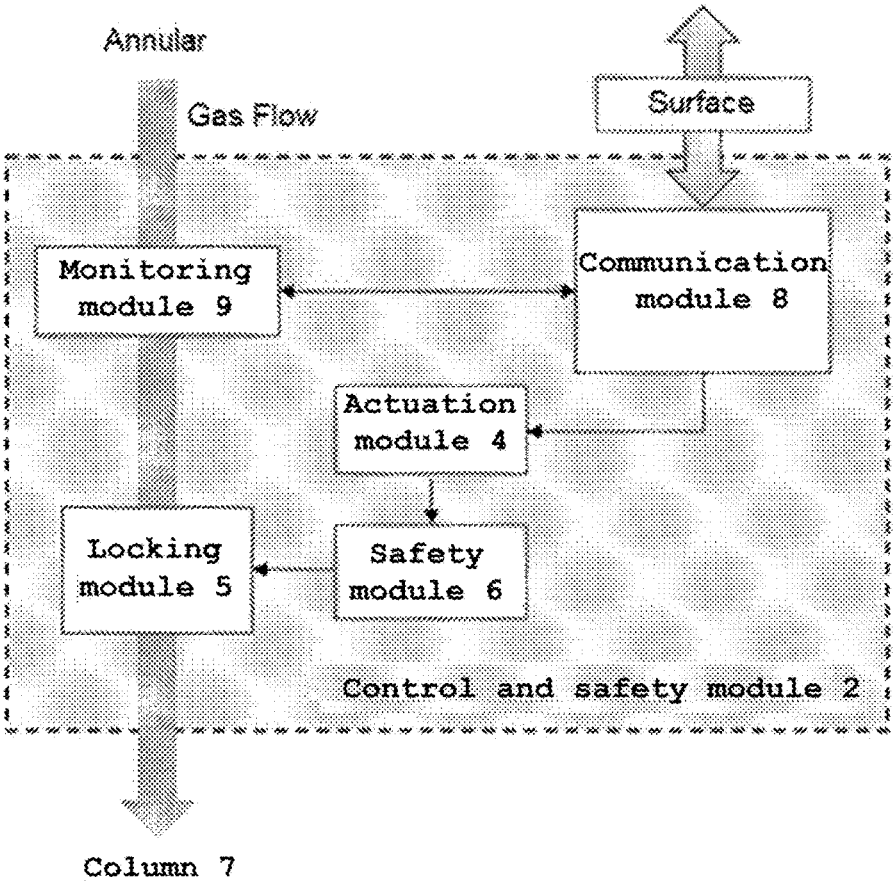
FIG. 4 illustrates a block diagram of the operability of the control and safety system of the present invention.

In accordance with the FIGS. 3 and 4, the control and safety system of the present invention is installed in such a way as to send and receive monitoring and command data to and from the surface data acquisition module, from which the operator controls the gas pressurization in the annular space, which will be supplied, through the safety control module, to the gas lift valve (1), to be injected into the production column.

The control and safety module (2) constitutes a sealing barrier between the annular space and the production column, operated electrically, with fail-safe-close.

The closing, by command or in an emergency, of the control and safety module occurs in a situation of production interruption, loss of energy and/or accident, to guarantee the integrity of the first joint set of safety barriers (JSB) of the well.

The control and safety system can be integrated into conventional systems of gas injection and mandrel, or in new concepts and designs of gas injection systems.

The control and safety system (2) will be actuated from the surface, by means of electric cable (3), with the continuous monitoring of the operating parameters.

The control and safety system provides for the integration of any type of sensor capable of monitoring all the parameters involved in the operation.

The control and safety system enables greater reliability in terms of the seal-tightness of the gas lift injection system, maintaining the integrity of the joint set of safety barriers (JSB) of the well, by the non-exposure or partial exposure thereof, to the fluid outflow.

The operation of the control and safety system is controlled by the actuation module (4), which keeps the locking module (5) in the open position during the gas injection operation, with residual energy consumption, and by the loss of energy, by command or in an emergency, instant closure will occur, through the safety module (6), with the blockage of the gas injection of the annular space for the production column (7), so as to guarantee the seal-tightness, and consequently, the integrity of the first joint set of safety barriers (JSB) of the well.

The opening and closing command of the gas injection is carried out electrically, from the surface, by the communication module (8).

The control and safety system further includes a sensor monitoring module (9) which checks, in real time, the operating parameters of the equipment and well.

The invention claimed is:

1. An electric drive valve control and safety system for gas injection in an oil production column of an oil well, said oil well having a set of primary safety barriers of the well, said system comprising:

a surface data acquisition module;

said oil production column including an annular space and a mandrel having a gas lift valve housed within said mandrel;

said gas lift valve configured for gas injection from said annular space in said oil production column;

said surface data acquisition module configured for sending and receiving monitoring and command data;

a control and safety module having a communication module which is configured to communicate with said surface data acquisition module;

said control and safety module further including a monitoring module, an actuation module, a safety module and a locking module;

said control and safety module being housed within said mandrel;

said monitoring module having sensors and is configured to communicate with said communication module in real time, for monitoring operating parameters of said oil production column;

said actuation module is configured to communicate with said communication module, and control said safety module;

said safety module configured to control said locking module in an open position for gas injection or a closed position for blocking the gas injection from said annular space in said oil production column; and wherein said system is configured to be operated from the surface to control communications and the pressurization of the gas in said gas lift valve in said annular space, which when communications are provided through said control and safety module, to enable or disable said gas lift valve, for gas injection into the production column, and wherein said actuation module is configured to keep said locking module in the fully open position during the gas injection operation, through residual energy consumption, and, in the event of an interruption in the supply of electricity or by emergency command, the instantaneous closing of said locking module with occur, through said safety module, blocking the injection of the gas from the annular space to the production column, ensuring the tightness and integrity of the set of primary safety barriers of the well.

2. The system according to claim 1, wherein said control and safety module constitutes, and functions as, a protective sealing barrier between the annular space and the production column, and is configured to be operated electrically, with fail-safe-close, and that upon receipt of a surface communication or power failure, said safety module and said locking module is configured to disable said gas lift valve for blockage of gas injection.

3. The system according to claim 1, wherein said locking module is in a closed position, by communication with the surface or in an emergency, occurs as a function of de-energization, said control and safety module ensures the integrity of a first joint set of safety barriers (JSB) of the well.

4. The system according to claim 1 further comprising: an electric cable, and the system configured to be actuated from the surface by means of the electric cable, and the electric cable configured to provide communications for the ongoing monitoring of the well operating parameters.

5. The system according to claim 1, having at least one sensor for monitoring desired parameters involved in said oil well production column operation, including one or more sensors for pressure, temperature, vibration, flow, and flow direction.

6. The system according to claim 1, wherein said control and safety module is housed within said mandrel as a separate module, independent of said gas lift valve and not integrated therein;

wherein, said control and safety module can be independently, serviced, maintained or replaced apart from said gas lift valve without affecting the gas lift valve, its components or functions.

* * * * *